US011187056B1

(12) United States Patent
Tenorio et al.

(10) Patent No.: US 11,187,056 B1
(45) Date of Patent: Nov. 30, 2021

(54) ROTATING CONTROL DEVICE SYSTEM

(71) Applicant: Cameron International Corporation, Houston, TX (US)

(72) Inventors: Harold Tenorio, Houston, TX (US); Vikas Rakhunde, Cypress, TX (US); Jon Tyler, Houston, TX (US); Matthew Givens, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/871,891

(22) Filed: May 11, 2020

(51) Int. Cl.
*E21B 33/08* (2006.01)
*F15B 15/14* (2006.01)

(52) U.S. Cl.
CPC ..... *E21B 33/085* (2013.01); *F15B 15/14* (2013.01)

(58) Field of Classification Search
CPC ..... E21B 33/085; F15B 15/14
See application file for complete search history.

(56) References Cited

U.S. PATENT DOCUMENTS

| | | | | |
|---|---|---|---|---|
| 4,448,255 | A * | 5/1984 | Shaffer | E21B 33/085 166/387 |
| 4,508,311 | A | 4/1985 | Just et al. | |
| 5,361,832 | A | 11/1994 | Van Winkle | |
| 5,588,491 | A | 12/1996 | Brugman et al. | |
| 6,352,129 | B1 | 3/2002 | Best | |
| 6,575,244 | B2 | 6/2003 | Chang et al. | |
| 6,904,981 | B2 | 6/2005 | Riet | |
| 7,004,448 | B2 | 2/2006 | Suter et al. | |
| 7,165,610 | B2 | 1/2007 | Hopper | |
| 7,185,719 | B2 | 3/2007 | Riet | |
| 7,350,597 | B2 | 4/2008 | Reitsma et al. | |
| 7,478,672 | B2 | 1/2009 | Rogers et al. | |
| 7,487,837 | B2 | 2/2009 | Bailey et al. | |
| 7,828,081 | B2 | 11/2010 | Reitsma | |
| 7,866,399 | B2 | 1/2011 | Kozicz et al. | |
| 8,096,711 | B2 | 1/2012 | Beauchamp et al. | |
| 8,286,734 | B2 | 10/2012 | Hannegan et al. | |
| 8,413,724 | B2 | 4/2013 | Carbaugh et al. | |
| 8,567,525 | B2 | 10/2013 | Reitsma | |
| 8,573,294 | B2 | 11/2013 | Struthers et al. | |

(Continued)

FOREIGN PATENT DOCUMENTS

| | | | |
|---|---|---|---|
| EP | 3261629 | A2 | 3/1988 |
| EP | 3231986 | A | 10/2017 |

(Continued)

OTHER PUBLICATIONS

International Search Report and Written Opinion issued in International Patent Application No. PCT/US2021/031481 dated Aug. 30, 2021; 10 pages.

*Primary Examiner* — James G Sayre

(57) ABSTRACT

A rotating control device (RCD) system includes a housing having a bore, a seal element positioned within the housing, a piston assembly supported within the housing and configured to drive the seal element to seal the bore, and a bearing assembly supported within the housing and configured to enable the seal element to rotate relative to the housing. The bearing assembly includes a first bearing section positioned between the housing and the seal element and a second bearing section positioned between a piston of the piston assembly and the seal element.

24 Claims, 5 Drawing Sheets

(56) References Cited

U.S. PATENT DOCUMENTS

| | | | |
|---|---|---|---|
| 8,596,345 | B2 | 12/2013 | Li et al. |
| 8,631,874 | B2 | 1/2014 | Kozicz et al. |
| 8,726,983 | B2 | 5/2014 | Khan |
| 8,757,272 | B2 | 6/2014 | Couturier et al. |
| 8,820,747 | B2 | 9/2014 | Zubia et al. |
| 8,844,633 | B2 | 9/2014 | Reitsma et al. |
| 9,038,729 | B2 | 5/2015 | Leduc et al. |
| 9,109,405 | B2 | 8/2015 | Carbaugh et al. |
| 9,109,420 | B2 | 8/2015 | Tindle et al. |
| 9,151,135 | B2 | 10/2015 | Eriksen |
| 9,228,433 | B2 | 1/2016 | Sawyer et al. |
| 9,284,811 | B2 | 3/2016 | Michaud et al. |
| 9,328,574 | B2 | 5/2016 | Sehsah |
| 9,341,037 | B2 | 5/2016 | Suter |
| 9,388,650 | B2 | 7/2016 | Leuchtenberg |
| 9,429,007 | B2 | 8/2016 | Reitsma et al. |
| 2012/0241163 | A1 | 9/2012 | Reitsma et al. |
| 2014/0048331 | A1 | 2/2014 | Boutalbi et al. |
| 2014/0209316 | A1 | 7/2014 | Tindle et al. |
| 2014/0216751 | A1 | 8/2014 | Liezenberg |
| 2014/0262313 | A1 | 9/2014 | Gilmore et al. |
| 2015/0034384 | A1 | 2/2015 | Leuchtenberg |
| 2018/0274323 | A1* | 9/2018 | Arefi ..... E21B 47/08 |
| 2019/0024473 | A1* | 1/2019 | Arefi ..... E21B 33/085 |

FOREIGN PATENT DOCUMENTS

| | | | |
|---|---|---|---|
| WO | 2007047800 | A2 | 4/2007 |
| WO | 2010082831 | A1 | 7/2010 |
| WO | 2012035001 | A2 | 3/2012 |
| WO | 2014087371 | A1 | 6/2014 |
| WO | 2018176058 | A2 | 9/2018 |

* cited by examiner

ROTATING CONTROL DEVICE SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources have a profound effect on modern economies and societies. In order to meet the demand for such natural resources, numerous companies invest significant amounts of time and money in searching for, accessing, and extracting oil, natural gas, and other natural resources. Particularly, once a desired natural resource is discovered below the surface of the earth, drilling systems are often employed to access the desired natural resource. These drilling systems can be located onshore or offshore depending on the location of the desired natural resource. Such drilling systems may include a drilling fluid system configured to circulate drilling fluid into and out of a wellbore to facilitate drilling the wellbore.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
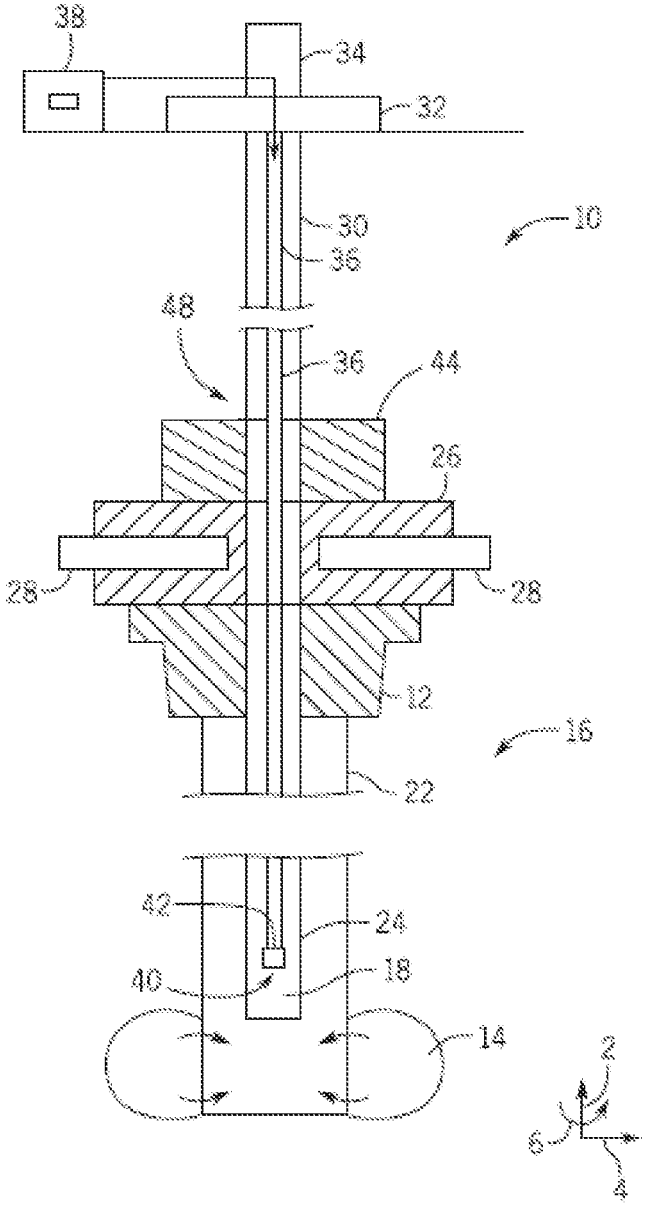
FIG. 1 is a schematic diagram of a drilling system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof. Numerical terms, such as "first," "second," and "third" are used to distinguish components to facilitate discussion, and it should be noted that the numerical terms may be used differently or assigned to different elements in the claims.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore.

In some cases, the drilling system may use managed pressure drilling ("MPD"). MPD regulates a pressure and a flow of the drilling fluid within the drill string so that the flow of the drilling fluid does not over pressurize a well (e.g., expand the well) and/or blocks the well from collapsing under its own weight. The ability to manage the pressure and the flow of the drilling fluid enables use of the drilling system to drill in various locations, such as locations with relatively softer sea beds.

The drilling system of the present disclosure may include a rotating control device (RCD) system. The RCD system may include a housing that defines a bore, and the drill string may extend through the bore during drilling operations. The RCD system may also include a seal element positioned within the housing, and the seal element may be configured to seal against the drill string to thereby block the drilling fluid, cuttings, and/or natural resources (e.g., carbon dioxide, hydrogen sulfide) from passing across the seal element of the RCD system from the well toward the platform. Advantageously, the seal element may also be configured to seal against itself while the drill string is absent from the bore. In some embodiments, the fluid flow may be diverted toward another suitable location (e.g., a collection tank) other than the platform.

As discussed in more detail below, the RCD system may include a bearing assembly (e.g., annular bearing assembly) that is configured to enable the seal element to rotate relative to the housing, such as with the drill string when the seal element is sealed against the drill string. The RCD system may include a piston assembly (e.g., annular piston assembly) that is configured to drive the seal element to seal against the drill string and/or itself to seal the bore. The components (e.g., seal element, bearing assembly, piston assembly) and capabilities of the RCD system (e.g., ability to adjust the seal and/or to seal the bore under various conditions, such as in the presence of the drill string as the drill string rotates and in the absence of the drill string) may enable the RCD system to effectively operate as an RCD and an annular blowout preventer (BOP) within the drilling system. Thus, the drilling system may not include an RCD and an annular BOP that are physically separate from one another and that each have a respective seal element, respective actuator to drive the respective seal element, and the like. Accordingly, the drilling system may utilize fewer components, have a lower cost, and/or a simplified operation.

FIG. 1 is a schematic diagram that illustrates an embodiment of a drilling system 10 that is configured to carry out drilling operations. The drilling system 10 may be a subsea system, although the disclosed embodiments may be used in a land-based (e.g., surface) system. The drilling system 10 may use MPD techniques. As illustrated, the drilling system 10 includes a wellhead assembly 12 coupled to a mineral deposit 14 via a well 16 having a wellbore 18.

The wellhead assembly 12 may include or be coupled to multiple components that control and regulate activities and conditions associated with the well 16. For example, the wellhead assembly 12 generally includes or is coupled to pipes, bodies, valves, and seals that enable drilling of the well 16, route produced minerals from the mineral deposit 14, provide for regulating pressure in the well 16, and provide for the injection of drilling fluids into the wellbore 18. A conductor 22 may provide structure for the wellbore 18 and may block collapse of the sides of the well 16 into the wellbore 18. A casing 24 may be disposed within the conductor 22. The casing 24 may provide structure for the wellbore 18 and may facilitate control of fluid and pressure during drilling of the well 16. The wellhead assembly 12 may include a tubing spool, a casing spool, and a hanger (e.g., a tubing hanger or a casing hanger) to enable installation of the casing 24. As shown, the wellhead assembly 12 may include or may be coupled to a blowout preventer (BOP) assembly 26, which may include one or more ram BOPs. For example, the BOP assembly 26 shown in FIG. 1 includes a ram BOP having moveable rams 28 configured to seal the wellbore 18.

A drilling riser 30 may extend between the BOP assembly 26 and a platform 32. The platform 32 may include various components that facilitate operation of the drilling system 10, such as pumps, tanks, and power equipment. The platform 32 may also include a derrick 34 that supports a tubular 36 (e.g., drill string), which may extend through the drilling riser 30. A drilling fluid system 38 may direct the drilling fluid into the tubular 36, and the drilling fluid may exit through one or more openings at a distal end portion 40 of the tubular 36 and may return (along with cuttings and/or other substances from the well 16) toward the platform 32 via an annular space (e.g., between the tubular 36 and the casing 24 that lines the wellbore 18; between the tubular 36 and the drilling riser 30). A drill bit 42 may be positioned at the distal end portion 40 of the tubular 36. The tubular 36 may rotate within the drilling riser 30 to rotate the drill bit 42, thereby enabling the drill bit 42 to drill and form the well 16.

As shown, the drilling system 10 may include a rotating control device (RCD) system 44 that is configured to form a seal across and/or to block fluid flow through the annular space that surrounds the tubular 36. For example, the RCD system 44 may be configured to block the drilling fluid, cuttings, and/or other substances from the well 16 from passing across a seal element of the RCD system 44 toward the platform 32. The RCD system 44 may be positioned at any suitable location within the drilling system 10, such as any suitable location between the wellbore 18 and the platform 32. For example, as shown, the RCD system 44 may be positioned between the BOP assembly 26 and the platform 32.

In operation, the tubular 36 may be rotated and/or moved along an axial axis 2 to enable the drill bit 42 to drill the well 16. As discussed in more detail below, the RCD system 44 may be controlled to provide a seal against the tubular 36 even as the tubular 36 is rotated and/or to seal against itself while the tubular 36 is absent. The drilling system 10 and its components may be described with reference to the axial axis 2 (or axial direction), a radial axis 4 (or radial direction), and a circumferential axis 6 (or direction) to facilitate discussion.

Figure 2:
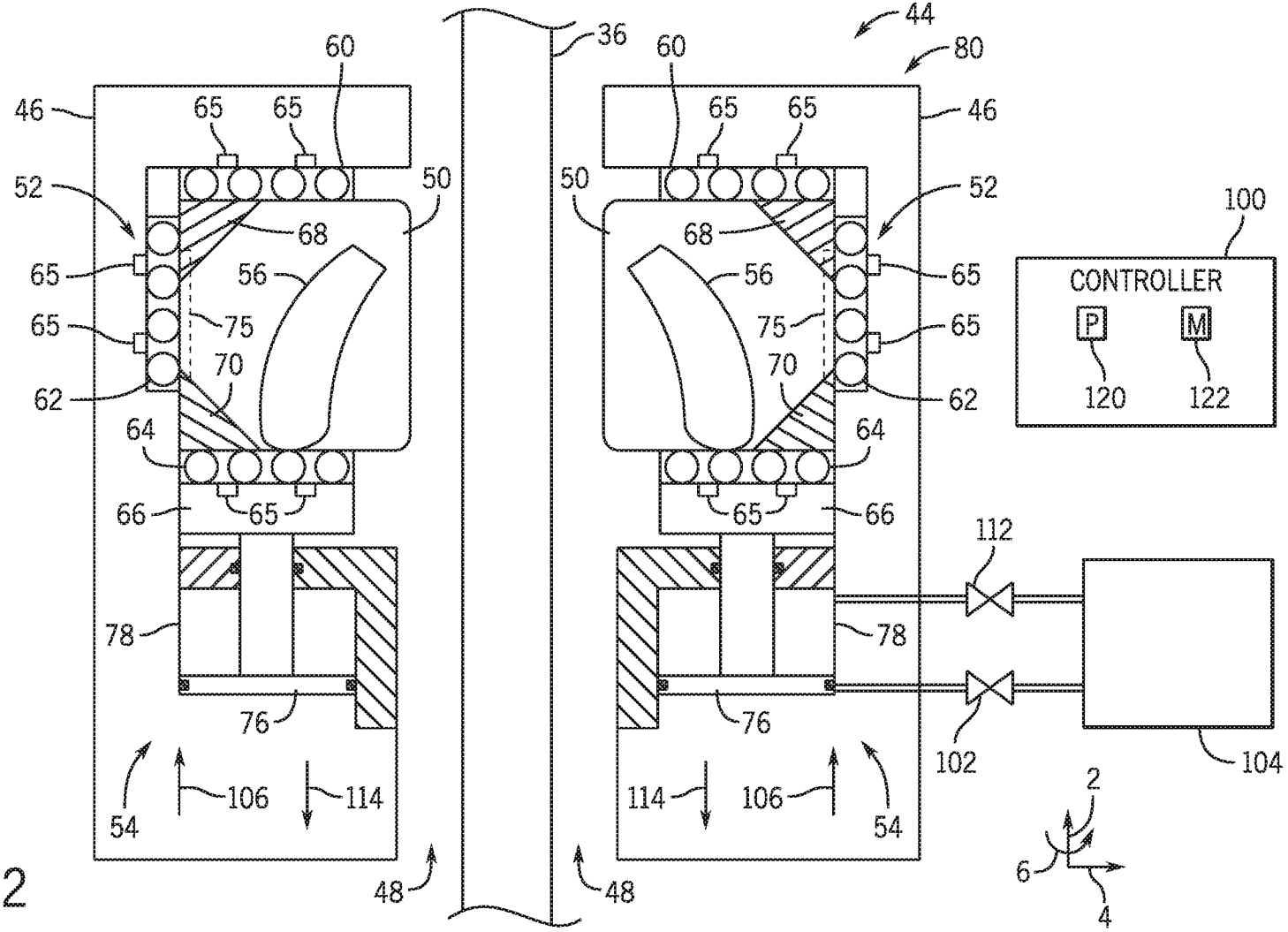
FIG. 2 is a cross-sectional side view of a rotating control device (RCD) system that may be used in the drilling system of FIG. 1, wherein the RCD system is in a first configuration, in accordance with an embodiment of the present disclosure.

FIG. 2 is a cross-sectional side view of an embodiment of the RCD system 44 that may be used in the drilling system of FIG. 1. As shown, the RCD system 44 includes a housing 46, a bore 48 extending through the housing 46, a seal element 50 (e.g., annular seal element) positioned within the housing 46, a bearing assembly 52 (e.g., annular bearing assembly) positioned within the housing 46, and a piston assembly 54 (e.g., annular piston assembly) positioned within the housing 46.

The seal element 50 may be any suitable seal material, such as an elastomer material. It should be appreciated that the seal element 50 may be an annular structure that wraps circumferentially around the bore 48. However, the seal element 50 may include multiple separate segments (e.g., that each extend about a half, a quarter, or an eighth of a circumference of the bore 48). As shown, multiple inserts 56 may be distributed circumferentially about and embedded within (e.g., surrounded by) the seal element 50. The inserts 56 may be any suitable materials, such as a metal (e.g., metal or metal alloy) material.

Additionally, the bearing assembly 52 may be arranged in any suitable manner that facilitates rotation of the seal element 50 relative to the housing 46. For example, the bearing assembly 52 may include a first bearing section 60 (e.g., annular bearing section) that is positioned between an inner surface (e.g., axially-facing annular surface) of the housing 46 and an upper surface (e.g., axially-facing annular surface) of the seal element 50, a second bearing section 62 (e.g., annular bearing section) that is positioned between a radially-inner surface (e.g., radially-facing annular surface) of the housing 46 and a radially-outer surface (e.g., radially-facing annular surface) of the seal element 50, and/or a third bearing section 64 that is positioned between an upper surface (e.g., axially-facing annular surface) of a push element 66 (e.g., annular push plate) of the piston assembly 54 and a lower surface (e.g., axially-facing annular surface) of the seal element 50.

In particular, the first bearing section 60 may include a respective outer ring that is coupled (e.g., via one or more fasteners 65, such as welds or threaded fasteners) to the lower surface of the housing 46, a respective inner ring that is configured to contact the upper surface of the seal element 50, and rolling elements (e.g., balls) positioned between the respective outer ring and the respective inner ring to facilitate rotation of the respective inner ring relative to the respective outer ring. The second bearing section 62 may include a respective outer ring that is coupled (e.g., via one or more fasteners 65, such as welds or threaded fasteners) to the radially-inner surface of the housing 46, a respective inner ring that is configured to contact and/or face the radially-outer surface of the seal element 50, and rolling elements (e.g., balls) positioned between the respective outer ring and the respective inner ring to facilitate rotation of the respective inner ring relative to the respective outer ring. The third bearing section 64 may include a respective outer ring that is coupled (e.g., via one or more fasteners 65, such as welds or threaded fasteners) to the upper surface of the push element 66, a respective inner ring that is configured to contact the lower surface of the seal element 50, and rolling elements (e.g., balls) positioned between the respective outer ring and the respective inner ring to facilitate rotation of the inner ring relative to the outer ring. As shown, the first bearing section 60 is positioned opposite the third bearing section 64.

The bearing assembly 52 may also include a first block 68 (e.g., annular block) and/or a second block 70 (e.g., annular block). As shown, the first block 68 may be coupled (e.g., via one more fasteners, such as welds or threaded fasteners) to the first bearing section 60 (e.g., to the respective inner ring of the first bearing section 60) and/or the second bearing section 62 (e.g., to the respective inner ring of the second bearing section 62), and the second block 70 may be coupled (e.g., via one more fasteners, such as welds or threaded fasteners) to the third bearing section 64 (e.g., to the respective inner ring of the third bearing section 64). The first block 68 and the second block 70 may each have a triangular cross-sectional shape and a tapered surface that contacts the seal element 50, and the first block 68 and the second block 70 may operate to wedge and/or to drive the seal element 50 radially-inwardly to form the seal against the tubular 36 or to seal against itself to seal the bore 48. The respective tapered surfaces of the first block 68 and the second block 70 may be tapered in opposite directions to one another. In particular, the tapered surface of the first block 68 may extend radially-outwardly from an upper portion at the first bearing section 60, and the tapered surface of the second block 70 may extend radially-outwardly from a lower portion at the third bearing section 64. In some embodiments, the first bearing section 60, the second bearing section 62, and/or the first block 68 may be coupled to one another.

Furthermore, in some embodiments, the second bearing section 62 may be omitted. In some such cases and/or in other cases, the first block 68 and the second block 70 may be sized and/or configured to block contact between the seal element 50 and the housing 46 (e.g., at least while the seal element 50 is sealed against the tubular 36; key-slot interface). For example, at least one of the first block 68 or the second block 70 may include an extension (e.g., axially-extending extension or key) that is positioned radially between the seal element 50 and the housing 46 to block contact between the seal element 50 and the housing 46, and the extension may be received within a slot (e.g., groove) of the other one of the first block 68 or the second block 70 to enable the first block 68 and the second block 70 to move relative to one another along the axial axis 2, as discussed in more detail below. An example of such a key-slot interface 75, which may be formed by the extension and the slot, is illustrated in FIG. 2. The piston assembly 54 may include the push element 66 and a piston 76 (e.g., annular piston) that moves within a chamber 78 (e.g., annular chamber). It should be appreciated that components that are described as coupled to one another may instead be integrally formed as one-piece.

Figure 3:
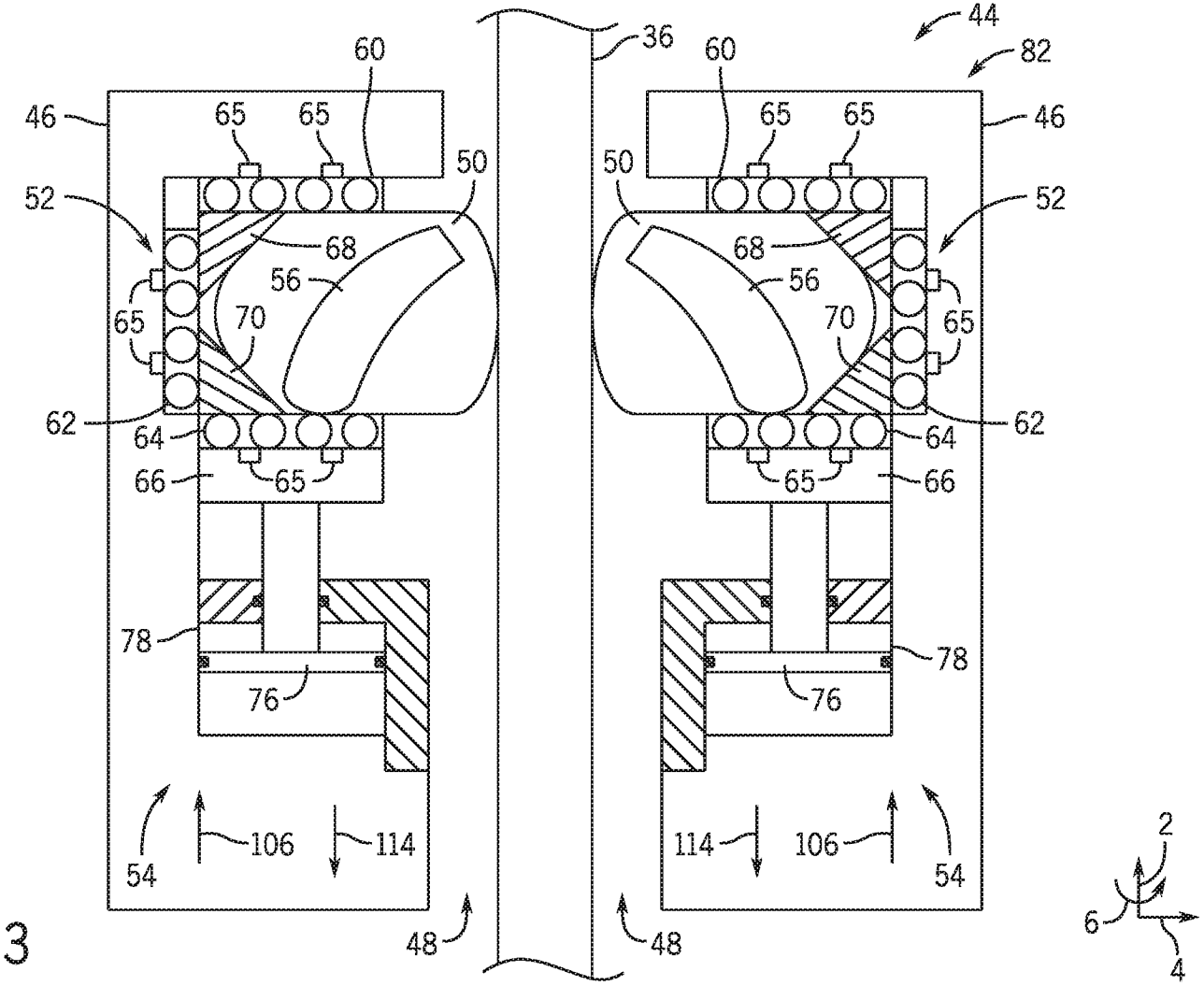
FIG. 3 is a cross-sectional side view of the RCD system of FIG. 2, wherein the RCD system is in a second configuration and a seal element of the RCD system is sealed against a tubular within a bore, in accordance with an embodiment of the present disclosure.
Figure 4:
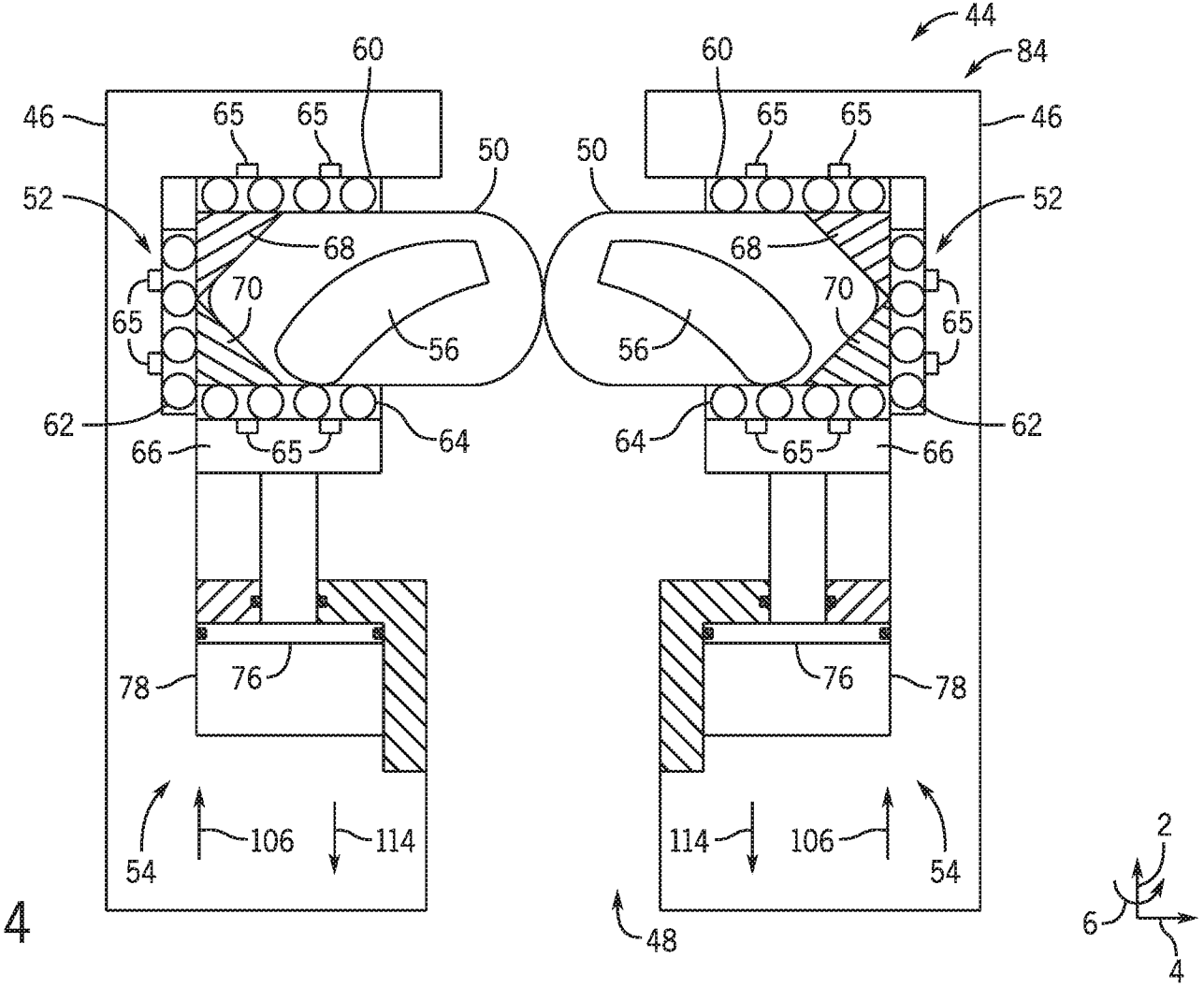
FIG. 4 is a cross-sectional side view of the RCD system of FIG. 2, wherein the RCD system is in a third configuration and the seal element of the RCD system is sealed against itself within the bore, in accordance with an embodiment of the present disclosure.

With the foregoing in mind, FIGS. 2-4 illustrate various configurations (e.g., operational configurations) of the RCD system 44. In particular, FIG. 2 is a cross-sectional side view of the RCD system 44 in a first configuration 80 (e.g., open configuration; unsealed configuration), FIG. 3 is a cross-sectional side view of the RCD system 44 in a second configuration 82 (e.g., closed configuration; sealed configuration) in which the seal element 50 is sealed against the tubular 36 to seal the bore 58, and FIG. 4 is a cross-sectional side view of the RCD system 44 in a third configuration 84 (e.g., closed configuration; sealed configuration) in which the seal element 50 is sealed against itself to seal the bore 48.

In the first configuration 80, the piston 76 may be at a first limit position (e.g., lower limit position) within the chamber 78, which enables the seal element 50 to be in a first state (e.g., vertically-expanded state). As illustrated in FIG. 2, in the first configuration 80, the seal element 50 may be withdrawn from the bore 48 and/or may not seal the bore 48. However, it should be appreciated that in the first configuration 80, the seal element 50 may be within the bore 48 and/or may seal the bore 48 (e.g., against the tubular 36 in the bore 48 with a relatively low sealing force as compared to the second configuration 82).

In the second configuration 82, the piston 76 may be at an intermediate position (e.g., between limit positions) within the chamber 78, which enables the seal element 50 to be in a second state (e.g., vertically-compressed state). As illustrated in FIG. 3, in the second configuration 82, the seal element 50 may seal the bore 48 (e.g., via sealing against the tubular 36 with relatively high sealing force as compared to the first configuration 80). In the third configuration 84, the piston 76 may be at a second limit position (e.g., upper limit position) within the chamber 78, which enables the seal element 50 to be in a third state (e.g., vertically-compressed state). As illustrated in FIG. 4, in the third configuration 84, the seal element 50 may seal the bore 48 (e.g., via sealing against itself; via sealing against the tubular 36 with a relatively high sealing force as compared to the second configuration 82). FIGS. 2-4 show the various components of the RCD system 44 with certain configurations and positions to facilitate discussion; however, it should be understood that the seal element 50 may be shaped and sized in any of a variety of ways to form the seal in the bore 48 (e.g., either by sealing against the tubular 36 and/or against itself) and the piston 76 may move to any position (e.g., between the limit positions) to adjust a compressive force on the seal element 50 to adjust the seal in the bore 48.

As an example, to adjust the RCD system 44 from the first configuration 80 of FIG. 2 to the second configuration 82 of FIG. 3, a controller 100 (e.g., electronic controller) may control a first actuator to control a first valve 102 to enable a flow of a fluid from a fluid source 104 to a first portion of the chamber 78. The fluid may drive the piston 76 along the axial axis 2 (e.g., vertically upward), as shown by arrow 106. As the piston 76 moves along the axial axis 2 in this manner, the push element 66, the third bearing section 64, and the second block 70 move along the axial axis 2 toward the first bearing section 60. Thus, the seal element 50 may be compressed along the axial axis 2 between the third bearing section 64 and the first bearing section 60. Furthermore, the second block 70 and the first block 68 may wedge the seal element 50 radially-inwardly toward the bore 48. As the seal element 50 is compressed and wedged in this manner, the inserts 56 may pivot and/or fold radially-inwardly (e.g., about a first end portion proximate to the third bearing section 64) to support (e.g., via a second end portion proximate to the first bearing section 60) the seal formed between the seal element 50 and the tubular 36. As shown, the first bearing section 60, the second bearing section 62, and the first block 68 may remain stationary relative to the axial axis 2, while the third bearing section 64 and the second block 70 attached thereto may move along the axial axis 2 (e.g. slide along the second bearing section 62, radially-inwardly of the second bearing section 62). Such a configuration blocks contact between the seal element 50 and the housing 46 and facilitates rotation of the seal element 50 relative to the housing 46. In particular, once the seal element 50 forms the seal against the tubular 36, rotation of the tubular 36 (e.g., to drill the wellbore) may drive rotation of the seal element 50 within the housing 46. The seal element 50, and the inserts 56 embedded therein, may rotate relative to the housing 46, the push element 66, and other components of the piston assembly 54. The respective inner rings, the first block 68, and the second block 70 may rotate with the seal element 50.

As shown in FIG. 3, the piston 76 is in the intermediate position within the chamber 78. Advantageously, the piston assembly 54 enables the piston 76 to move between the limit positions to achieve a range of compressive forces on the seal element 50 and a range of corresponding sealing forces between the seal element 50 and the tubular 36. For example, the controller 100 may adjust the flow of the fluid to provide additional fluid to the first portion of the chamber 78 to drive the piston 76 along the axial axis 2 (e.g., vertically upward, such as to or toward the limit position of FIG. 4) while the tubular 36 is within the bore 48, which will thereby provide an increased compressive force on the seal element 50 and an increased sealing force between the seal element 50 and the tubular 36.

As noted above, at certain times, the tubular 36 may not be present within the bore 48. At such times, the RCD system 44 may be configured to compress and to drive the seal element 50 radially-inwardly to seal against itself to seal the bore 48. For example, with reference to FIG. 4, the controller 100 may control the first actuator to control the first valve 102 to increase the fluid within the first portion of the chamber 78. The fluid may drive the piston 76 along the axial axis 2 (e.g., vertically upward), as shown by arrow 106. As the piston 76 moves along the axial axis 2 in this manner, the push element 66, the third bearing section 64, and the second block 70 move along the axial axis 2 toward the first bearing section 60. Thus, the seal element 50 may be compressed along the axial axis 2 between the third bearing section 64 and the first bearing section 60. Furthermore, the second block 70 and the first block 68 may wedge the seal element 50 radially-inwardly toward the bore 48. As the seal element 50 is compressed and wedged in this manner, the inserts 56 may pivot and/or fold radially-inwardly to support the seal formed by the seal element 50 sealing against itself. As shown, the first bearing section 60, the second bearing section 62, and the first block 68 may remain stationary relative to the axial axis 2, while the third bearing section 64 and the second block 70 attached thereto may move along the axial axis 2.

To move from the third configuration 84 of FIG. 4 to the second configuration 82 of FIG. 3, or to move from the second configuration 82 of FIG. 3 to the first configuration 80 of FIG. 2, the controller 100 may control a second actuator to control a second valve 112 to enable a flow of the fluid from the fluid source 104 to a second portion of the chamber 78. The fluid may drive the piston 76 along the axial axis 2 (e.g., vertically downward), as shown by arrow 114. As the piston 76 moves along the axial axis 2 in this manner, the push element 66, the third bearing section 64, and the second block 70 move along the axial axis 2 away from the first bearing section 60. Thus, the seal element 50 may be allowed to expand along the axial axis 2 between the third bearing section 64 and the first bearing section 60.

The controller 100 may control the delivery of the fluid to the chamber 78 based on any of a variety of inputs, such as in response to an input received from a user interface device at the platform (e.g., from an operator) and/or in response to an input received from one or more sensors, such as one or more sensors that monitor one or more parameters indicative of a seal formed between the seal element 50 and the tubular 36, a seal formed by the seal element 50 against itself, wellbore conditions, presence or absence of the tubular 36, rotation of the tubular 36, or the like. For example, the controller 100 may receive an input that indicates an undesirable pressure below the RCD system 44 (e.g., between the wellhead and the RCD system 44) and/or above the RCD system, 44 (e.g., between the platform and the RCD system 44) and may then adjust (e.g., increase) the flow of the fluid to the first portion of the chamber 78 to thereby form and/or adjust (e.g., increase) the seal (e.g., sealing force) formed by the seal element 50. As another example, the controller 100 may receive an input that indicates that the tubular 36 is absent from the bore 48, and the controller 100 may then adjust (e.g., increase) the flow of the fluid to the first portion of the chamber 78 to thereby drive the piston 76 to the limit position to cause the seal element 50 to seal against itself to seal the bore 48. In this way, the RCD system 44 may provide an adjustable seal in the presence or in the absence of the tubular 36 within the bore 48.

It may be desirable to include a feedback system that provides an indication of the configuration of the RCD system 44, which corresponds to the compressive force on the seal element 50 as well as the sealing force applied by the seal element 50. The feedback system may include one or more sensors that provide signals indicative of the configuration of the RCD system 44, such as by monitoring the position of the piston 76 within the chamber 78 and/or by monitoring the position of some other component, such as the third bearing section 64. It should be appreciated that any of a variety of other position-sensing sensor type(s) may be utilized, such as an internal linear displacement transducer (LDT), an external LDT, an optical sensor, and/or acoustic sensor. Regardless of the sensor type(s), the one or more sensors may output the signals to the controller 100 so that the controller 100 may process the signals to determine the configuration of the RCD system 44 and/or to determine whether to control the first actuator to adjust the first valve 102 or to control the second actuator to adjust the second valve 112 to adjust the position of the piston 76 within the chamber 78. Then, the controller 100 may provide control signals accordingly, as discussed above.

As shown in FIG. 2, the controller 100 includes the processor 120 and the memory device 122. It should be appreciated that the controller 100 may be a dedicated controller for the RCD system 44 and/or the controller 100 may be part of or include a distributed controller with one or more electronic controllers in communication with one another to carry out the various techniques disclosed herein. The processor 120 may also include one or more processors configured to execute software, such as software for processing signals and/or controlling the components of the RCD system 44. The memory device 122 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 122 may store processor-executable instructions (e.g., firmware or software) for the processor 120 to execute, such as instructions for processing signals and/or controlling the components of the RCD system 44. It should be appreciated that the controller 100 may include various other components, such as a communication device that is capable of communicating data or other information (e.g., a position of the piston 76 within the chamber 78) to various other devices (e.g., a remote computing system or display system at the platform).

Figure 5:
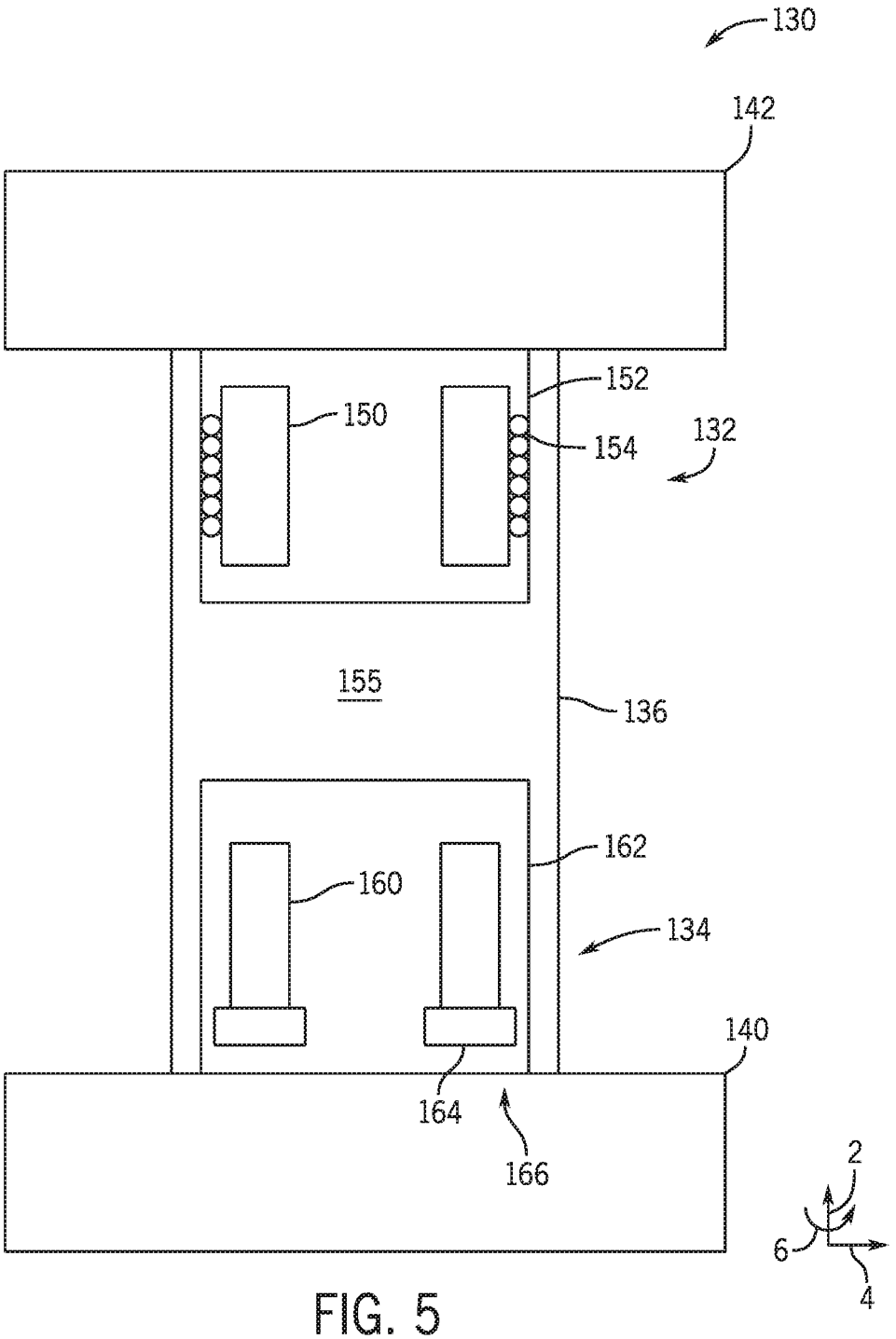
FIG. 5 is a schematic diagram of an RCD system that may be used in the drilling system of FIG. 1, wherein the RCD system includes an RCD and an annular blowout preventer (BOP) within a common housing, in accordance with an embodiment of the present disclosure.

FIG. 5 is an embodiment of an RCD system 130 that may be used in place of the RCD system 44 in the drilling system of FIG. 1. The RCD system 130 includes an RCD 132 and an annular blowout preventer (BOP) 134 within a common housing 136. The common housing 136 may be a one-piece housing (e.g., integrally formed; gaplessly continuous) that extends between a first end portion 140 (e.g., flange; connector configured to connect to another annular component, such as a ram BOP) and a second end portion 142 (e.g., flange; connector configured to connect to another annular component, such as a riser). In some embodiments, no other flanges or connectors (e.g., bolted connectors) may be provided between the first end portion 140 and the second end portion 142.

The RCD 132 and the annular BOP 134 may be positioned between the first end portion 140 and the second end portion 142. The RCD 132 may include an RCD seal element 150 that is rotatably supported within an RCD cavity 152 of the common housing 136 (e.g., via a bearing assembly 154, which may be an annular bearing assembly). In operation, the RCD seal element 150 may be positioned in a bore 155 of the common housing 136 to seal against a tubular and/or to seal against itself, and the RCD seal element 150 may be configured to rotate relative to the common housing 136 via the bearing assembly 154 (e.g., due to rotation of the tubular). Additionally, the annular BOP 134 may include an annular BOP seal element 160 that is supported within an annular BOP cavity 162 of the common housing 136. In operation, the annular BOP seal element 160 may be driven into the bore 155 of the common housing 136 to seal against the tubular and/or to seal against itself (e.g., via actuation of a piston 164 of a piston assembly 166, which may drive the piston 164 vertically upwardly to compress the annular BOP seal element 160 between an upper surface of the annular BOP cavity 162, which may drive the annular BOP seal element 160 radially-inwardly into the bore 155). It should be appreciated that various types of actuation assemblies may be utilized to position the RCD seal element 150 and the annular BOP seal element 160 within the bore 155.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. A rotating control device (RCD) system, comprising:

a housing comprising a bore;

a seal element positioned within the housing;

a piston assembly supported within the housing and configured to drive the seal element to seal the bore; and a bearing assembly supported within the housing and configured to enable the seal element to rotate relative to the housing, wherein the bearing assembly comprises a first bearing section positioned between the housing and the seal element and a second bearing section positioned between a piston of the piston assembly and the seal element, wherein the piston assembly is configured to selectively actuate the seal element into at least a first configuration and a second configuration, the seal element in the first configuration extending into the bore and sealing with a tubular therein, and the seal element in the second configuration extending entirely through the bore and sealing the bore without a tubular extending therein.

2. The RCD system of claim 1, wherein the first bearing section and the second bearing section are positioned on opposite sides of the seal element along an axial axis.

3. The RCD system of claim 1, wherein the first bearing section is positioned between a respective axially-facing surface of the housing and a respective axially-facing surface of the seal element.

4. The RCD system of claim 1, wherein the first bearing section is positioned between an inner surface of the housing and an upper surface of the seal element.

5. The RCD system of claim 1, wherein the second bearing section is positioned between a respective axially-facing surface of the piston and a respective axially-facing surface of the seal element.

6. The RCD system of claim 1, wherein the second bearing section is positioned between an upper surface of the piston and a lower surface of the seal element.

7. The RCD system of claim 1, wherein the bearing assembly comprises a third bearing section that is positioned between a radially-inner surface of the housing and a radially-outer surface of the seal element.

8. The RCD system of claim 1, wherein the bearing assembly comprises a first block coupled to the first bearing section and a second block coupled to the second bearing section, and each of the first block and the second block comprises a respective tapered surface that is configured to wedge the seal element as the piston assembly drives the seal element to seal the bore.

9. The RCD system of claim 8, wherein the respective tapered surface of the first block and the respective tapered surface of the second block are tapered in opposite directions along an axial axis.

10. The RCD system of claim 8, wherein at least one of the first or second blocks comprises an extension that is positioned radially between the seal element and the housing and is configured to block contact between the seal element and the housing, and wherein at least one of the first or second blocks comprises a slot for receiving the extension.

11. The RCD system of claim 1, comprising a plurality of inserts embedded within the seal element.

12. The RCD system of claim 1, wherein the second bearing section is coupled to the piston and is configured to move with the piston as the piston drives the seal element to seal the bore.

13. The RCD system of claim 12, wherein the second bearing section and the piston are configured to move along an axial axis toward the first bearing section to thereby compress the seal element between the second bearing section and the first bearing section along the axial axis.

14. The RCD system of claim 1, wherein the bearing section further comprises:

a third bearing section positioned axially between the first and second bearing sections, the first bearing section being positioned between the housing and a first axial surface of the seal element, and the second bearing surface being positioned between the piston and a second axial surfaces of the seal element, the first and second axial surface being opposite to one another; and a first block coupled to the second bearing section on an axial side of the first block and engaging the third bearing section on a radial outside of the first block, the first block comprising a tapered surface that engages a tapered surface of the sealing element.

15. The RCD system of claim 14, wherein the piston is configured to move the second bearing section and the first block toward the first bearing section and axially relative to the third bearing section, and wherein the first block moving toward the first bearing section compresses the sealing element axially and presses the sealing element radially inwards.

16. A rotating control device (RCD) system, comprising:

a housing comprising a bore;

a seal element positioned within the housing;

a piston assembly supported within the housing and configured to drive the seal element to seal the bore; and a bearing assembly supported within the housing and configured to enable the seal element to rotate relative to the housing, wherein the bearing assembly comprises a first bearing section and a first block coupled to the first bearing section, the first block comprises a tapered surface that is configured to wedge the seal element as the piston assembly drives the seal element to seal the bore and, and the first block is configured to rotate with the seal element relative to the housing, wherein the piston assembly is configured to selectively actuate the seal element into at least a first configuration and a second configuration, the seal element in the first configuration extending into the bore and sealing with a tubular therein, and the seal element in the second configuration extending entirely through the bore and sealing the bore without a tubular extending therein.

17. The RCD system of claim 16, wherein the bearing assembly comprises a second bearing section and a second block coupled to the second bearing section, and the second block comprises a respective tapered surface that is configured to wedge the seal element as the piston assembly drives the seal element to seal the bore, and the second block is configured to rotate with the seal element relative to the housing.

18. The RCD system of claim 17, wherein the first bearing section is positioned between an inner surface of the housing and a respective upper surface of the seal element, and the second bearing section is positioned between a respective upper surface of a piston of the piston assembly and a lower surface of the seal element.

19. The RCD system of claim 18, wherein the bearing assembly comprises a third bearing section that is positioned between a radially-inner surface of the housing and a radially-outer surface of the seal element.

20. The RCD system of claim 17, wherein the respective tapered surface of the first block and the respective tapered surface of the second block are tapered in opposite directions along an axial axis.

21. The RCD system of claim 17, wherein the second bearing section is coupled to a piston of the piston assembly and is configured to move with the piston as the piston assembly drives the seal element to seal the bore, and the second bearing section and the piston are configured to move along an axial axis toward the first bearing section to thereby compress the seal element between the second bearing section and the first bearing section along the axial axis.

22. A drilling system, comprising:

a rotating control device system, comprising:

a housing comprising a bore;

a seal element positioned within the housing;

a piston assembly supported within the housing and configured to drive the seal element to seal the bore; and a bearing assembly supported within the housing and configured to enable the seal element to rotate relative to the housing, wherein the bearing assembly comprises a first bearing section and a second bearing section that are positioned on opposite sides of the seal element along an axial axis, and the second bearing section is coupled to a piston of the piston assembly and is configured to move with the piston as the piston moves along the axial axis to drive the seal element to seal the bore, wherein the piston assembly is configured to selectively actuate the seal element into at least a first configuration and a second configuration, the seal element in the first configuration extending into the bore and sealing with a tubular therein, and the seal element in the second configuration extending entirely through the bore and sealing the bore without a tubular extending therein.

23. The drilling system of claim 22, comprising a controller that is configured to control one or more valves to adjust a flow of fluid to a chamber of the piston assembly to drive the seal element into the first configuration so as to seal the bore via contact with the tubular in the bore while the tubular is present within the bore or into the second configuration in which the seal element seals the bore via contact with itself within the bore while the tubular is absent from the bore.

24. The drilling system of claim 22, wherein the housing is a one-piece housing, the drilling system further comprising an annular blowout preventer having a non-rotating seal element configured to seal the bore, the annular blowout preventer being disposed within the one-piece housing and axially offset from the rotating control device system.

* * * * *